US009151560B2

(12) United States Patent
Myers et al.

(10) Patent No.: US 9,151,560 B2
(45) Date of Patent: Oct. 6, 2015

(54) FIREARM SOUND SUPPRESSOR

(75) Inventors: James R Myers, Altamonte Springs, FL (US); David B Fricke, Quakertown, PA (US); Michael Register, Apopka, FL (US); Thomas J Miller, III, Apopka, FL (US)

(73) Assignee: Spike's Tactical, LLC, Apopka, FL (US)

( * ) Notice: Subject to any disclaimer, the term of this patent is extended or adjusted under 35 U.S.C. 154(b) by 310 days.

(21) Appl. No.: 13/530,839

(22) Filed: Jun. 22, 2012

(65) Prior Publication Data

US 2013/0340313 A1 Dec. 26, 2013

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 89/14.1, 14.4; 42/90; 181/223
See application file for complete search history.

(56) References Cited

U.S. PATENT DOCUMENTS

| | | | | |
|---|---|---|---|---|
| 6,374,718 | B1 * | 4/2002 | Rescigno et al. | 89/14.4 |
| 7,013,592 | B2 * | 3/2006 | Olson et al. | 42/76.02 |
| 7,661,349 | B1 * | 2/2010 | Brittingham | 89/14.4 |

* cited by examiner

*Primary Examiner* — Stephen M Johnson
*Assistant Examiner* — Benjamin Gomberg
(74) *Attorney, Agent, or Firm* — Wood, Herron & Evans, LLP

(57) ABSTRACT

The present invention is for a firearm sound suppressor which is attached to the barrel of a firearm to reduce the noise and flash generated by the firearm. The firearm sound suppressor improves the dissipation of heat and provides a breach head on the end thereof for use as a ramming and breaching instrument.

9 Claims, 1 Drawing Sheet

FIREARM SOUND SUPPRESSOR

BACKGROUND OF THE INVENTION

The present invention relates to a firearm sound suppressor which is attached to the barrel of a firearm to reduce the noise and flash generated by the firearm and especially to a firearm sound suppressor that improves the dissipation of heat and provides a breach head on the end thereof for use as a ramming and breaching instrument.

A firearm sound suppressor typically mounts to the end of the muzzle of a firearm and is usually a hollow metal cylinder which has expansion chambers therein and which attaches to the muzzle of a firearm. This type of sound suppressor is readily attached to the end of a firearm barrel and may be used on different firearms of the same caliber.

Firearms also commonly use muzzle brakes or recoil compensators which counter recoil of the firearm and an unwanted rising of the barrel during rapid fire of the firearm. The muzzle brake is also generally attached to the muzzle end of a firearm and directs the bullet propellant gases upward to reduce muzzle climb and to some extent also the recoil in firearms.

The firearm suppressor suppresses noise by allowing the rapidly expanding gases from the firing of a cartridge to be diverted or trapped inside a series of chambers. The trapped gas expands and cools, reducing its pressure and velocity before it exits the suppressor. The suppressor chamber may be a single large expansion chamber located at the muzzle end of a firearm to allow the propellent gas to expand considerably and slow before it encounters the baffles therein. Baffles used in sound suppressors are usually circular metal dividers which separate the expansion chamber with each baffle having a hole therethrough to permit passage of gas through the baffle. The aperture in each baffle and the passageway through the sound suppressor is generally slightly larger than the bullet caliber to reduce the risk of a bullet hitting the sides of the housing in the sound suppressor. A sound suppressor housing can become heated to a very high temperature because of the collection of rapidly expanding gases from firing of multiple cartridges, especially in rapid fire weapons.

The present application addresses this problem by substantially increasing the surface area of the external housing of the suppressor for more rapid dissipation of the heat therefrom. In addition, the user of a firearm often needs a ramming or breaching tool which usually is not available in the field.

The present sound suppressor has a ram built onto the end thereof so that the firearm can be used as a ram or breaching device without damaging the firearm. The ram is provided with a cover or cap when not being used which covers the end of the ram to prevent the ram from catching on or snagging on something when the ram is not being used.

SUMMARY OF THE INVENTION

The present invention is for a firearm sound suppressor for use with a firearm having a barrel and includes an elongated tubular body having a forward end and a rear portion along with an exterior periphery having a passageway through the tubular body for the passage of a projectile from a firearm barrel muzzle. An elongated body external periphery has a plurality of dimples formed therein each of which may be a generally circular indentation into the housing to provide a greater surface for the exterior housing of the firearm sound suppressor to thereby better dissipate heat therefrom. The plurality of dimples may cover at least 50% of the tubular body with 100 or more dimples therein with each dimple being between 1/16 and 3/16th of an inch in diameter. The sound suppressor also has a breach device or ram formed on the forward end thereof which may have a threaded cover which is threadedly attached over the ram onto the tubular body. The cover has a center opening for the projectile to pass therethrough. The ram cover is generally cylindrically shaped and has a knurled surface on the periphery thereof. The firearm sound suppressor is removably attached to the firearm barrel muzzle for improved heat dissipation from the body thereof and provides a readily available ram or breaching device.

BRIEF DESCRIPTION OF THE DRAWINGS

The accompanying drawings which are included to provide a further understanding of the invention are incorporated in and constitute a part of the invention and, together with the description, serves to explain the principles of the invention in which.

DESCRIPTION OF AN EXEMPLARY EMBODIMENT

Figures 1, 2, 3, 4:
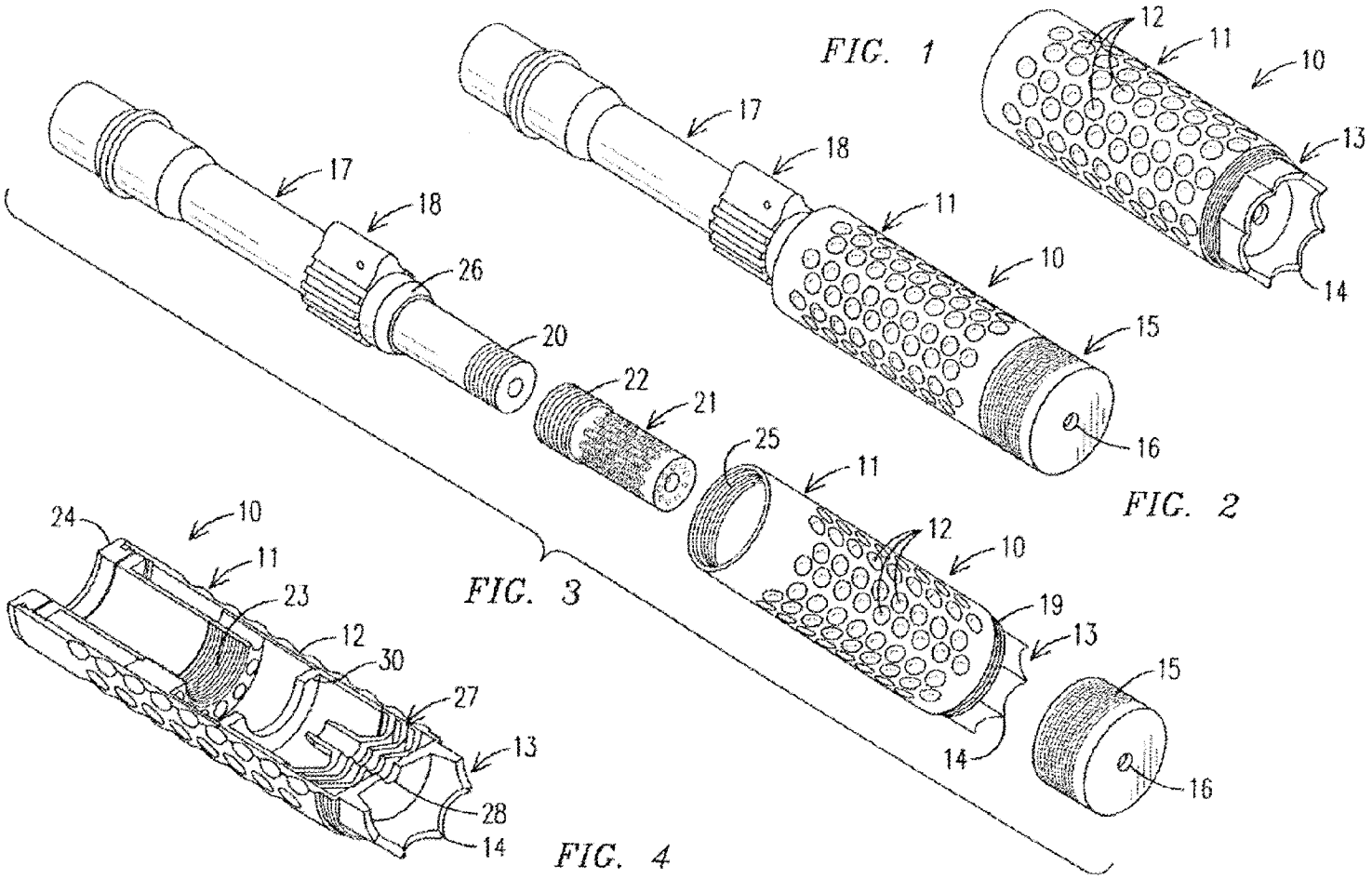
FIG. 1 is a perspective view of a firearm sound suppressor in accordance with the present invention having the breach cap removed.
FIG. 2 is a perspective view of the sound suppressor of FIG. 1 having attached to a firearm barrel with the breach cap attached.
FIG. 3 is an exploded perspective view of the sound suppressor of FIG. 2.
FIG. 4 is sectional view taken through the perspective of the sound suppress of FIGS. 1-3.

Referring to the drawings, FIGS. 1-4, a firearm sound suppressor 10 has an external housing having a plurality of peripheral circular indentations or dimples 12 formed into the outer surface. These sunken areas in the outer surface greatly expand the total surface area and allow the heated housing to cool more rapidly. The sound suppressor housing has a ram or breach head 13 on the front thereof so that a weapon having the sound suppressor attached thereto can be used as a breaching tool without damaging the weapon. The breach head 13 is circular and has a plurality of pointed protrusions 14 thereon. The sound suppressor 10 is also threaded at the end thereof just inside the breach head 13. These threads 13 allow for a cap or cover 15 to be threadedly attached over the breach head 13 to protect the breach head and to prevent the breach head from becoming snagged on things when not in use. The cover 15 has an opening 16 through the center thereof for the passage of a projectile there through.

The sound suppressor 10 having the cover 15 over the breach head 13 is shown in FIG. 2 attached to a gun barrel 17. The barrel 17 also has a gas block 18 attached thereto and has exterior threads 20 on the end thereof. A muzzle brake 21 has internal threads and threadedly attaches to the barrel 17 external threads 20. The sound suppressor 10 housing 11 is attached to the barrel by attaching the internal threads 23 as seen in FIG. 4 to the external threads 22 of the muzzle brake 21 threads 22 which attached to the barrel 17 with threads 20. The sound suppressor housing 11 has a compression retainer 24 threaded onto threads 25 of the sound suppressor housing 11 which compresses against the gas block beveled edge 26 to apply a tension to the barrel 17. The sound suppressor 10 sound suppressing baffles 27 are shown in FIG. 4 located at the front end of the suppressor housing 11 which has an opening 28 for a projectile to pass therethrough. The muzzle brake 21 is also housed in the suppressor housing 11 and extends up into the opening 30.

The dimples 12 on the surface of the sound suppressor housing 11 are used to enlarge the surface area of the exterior of the housing. They generally cover the entire surface to increase the cooling of the surface from the heat of the suppressor 11 and muzzle brake 21 which is housed inside the sound suppressor housing 11. The large number of indentations or dimples cover a large part of the surface such as 80% but always more than that 50% with dimples of any desired size but normally having 100 or more dimples 12. The depth of the dimples can be as desired but the greater depth increases the surface area but is limited by the wall thickness of the housing 11.

It should be clear at this time that a sound suppressor has been provided which improves heat dissipation therefrom and to advantageously provide a removably covered bread head for ready use by a firearm user. However the present invention is not to be considered limited to the forms shown which are to be considered illustrative rather than restrictive.

We claim:

1. A firearm sound suppressor for use with a firearm having a barrel comprising:

an elongated tubular body housing a sound suppressor and having a forward end and a rear portion and an external periphery and having a passageway therethrough for the passage of a projectile from a firearm barrel muzzle, said elongated body external periphery having a plurality of dimples formed therein, said dimples being circular indentations covering at least 50% of the elongated tubular body external periphery with at least 100 dimples therein, each said dimple being between 1/16 and 3/16 of an inch in diameter;

said elongated body having firearm barrel attaching means on the rear portion thereof for attaching said elongated tubular body to the end of a firearm barrel;

said elongated tubular body having a ram formed on the forward end thereof and having a plurality of spikes thereon; and said elongated tubular body having an externally threaded forward end and including a ram cover having internal threads for mounting over said ram and being threadedly attached to said externally threaded forward end of said tubular body.

2. The firearm sound suppressor in accordance with claim 1 in which said ram cover has a center opening therein for a projectile to pass through.

3. The firearm sound suppressor in accordance with claim 2 in which said ram cover is generally cylindrically shaped and has a knurled surface on the periphery thereof.

4. The firearm sound suppressor in accordance with claim 3 in which said ram cover has an aperture sized and positioned for a projectile from said firearm muzzle to pass through.

5. A firearm sound suppressor for use with a firearm having a barrel, comprising:

an elongated tubular body housing a sound suppressor having a forward end, a rear portion, an external periphery, and a passageway therethrough for the passage of a projectile from a firearm barrel muzzle, the elongated body having firearm barrel attaching means on the rear portion thereof for attaching the elongated tubular body to the end of a firearm barrel; and a ram formed on the forward end of the elongated tubular body and having a plurality of spikes thereon, the elongated tubular body having an externally threaded forward end and including a ram cover having internal threads for mounting over said ram and being threadedly attached to the externally threaded forward end of the tubular body.

6. The firearm sound suppressor in accordance with claim 5 in which the elongated body external periphery having a plurality of dimples formed therein.

7. The firearm sound suppressor in accordance with claim 6, wherein the elongated tubular body external dimples are circular indentations substantially covering the elongated tubular body external periphery.

8. The firearm sound suppressor in accordance with claim 6, wherein the dimples on the tubular body cover at least 50% of said tubular body with at least 100 dimples therein.

9. The firearm sound suppressor in accordance with claim 6, wherein each dimple is between 1/16 and 3/16 of an inch in diameter.

* * * * *